United States Patent [19]

Takahashi et al.

[11] 4,363,662

[45] Dec. 14, 1982

[54] ABRASION RESISTANT FERRO-BASED SINTERED ALLOY

[75] Inventors: Kentaro Takahashi, Omiya; Takeshi Hiraoka, Ageo; Shigeru Urano, Omiya, all of Japan

[73] Assignee: Nippon Piston Ring Co., Ltd., Tokyo, Japan

[21] Appl. No.: 151,079

[22] Filed: May 19, 1980

[30] Foreign Application Priority Data

May 17, 1979 [JP] Japan ..... 54/59733

[51] Int. Cl.[3] ..... B22F 3/00

[52] U.S. Cl. ..... 75/243; 75/236; 75/246

[58] Field of Search ..... 75/236, 243, 246

[56] References Cited

U.S. PATENT DOCUMENTS 3,694,173 9/1972 Farmer ..... 75/126 A 3,837,816 9/1974 Takahashi et al. ..... 75/236

3,982,907 9/1976 Honma ..... 75/236

*Primary Examiner*—Brooks H. Hunt

*Attorney, Agent, or Firm*—Sughrue, Mion, Zinn, Macpeak & Seas

[57] ABSTRACT

An abrasion resistant ferro-based sintered alloy comprising 1.1 to 1.6% by weight of carbon, 1.5 to 3.5% by weight of chromium, 1.6 to 2.9% by weight of molybdenum, 1.0 to 3.0% by weight of nickel, 3.0 to 5.0% by weight of cobalt, 0.5 to 1.5% by weight of tungsten, 1.8 to 18.0% by weight of copper and the balance iron wherein said alloy contains particles of specific alloy comprising C-Cr-W-Co and ferromolybdenum particles are uniformly dispersed in the base structure comprising a mixture of pearlite, bainite and martensite and wherein nickel and cobalt are distributed around the particles of specific alloy and of ferromolybdenum alloy is disclosed.

1 Claim, 1 Drawing Figure

FIGURE
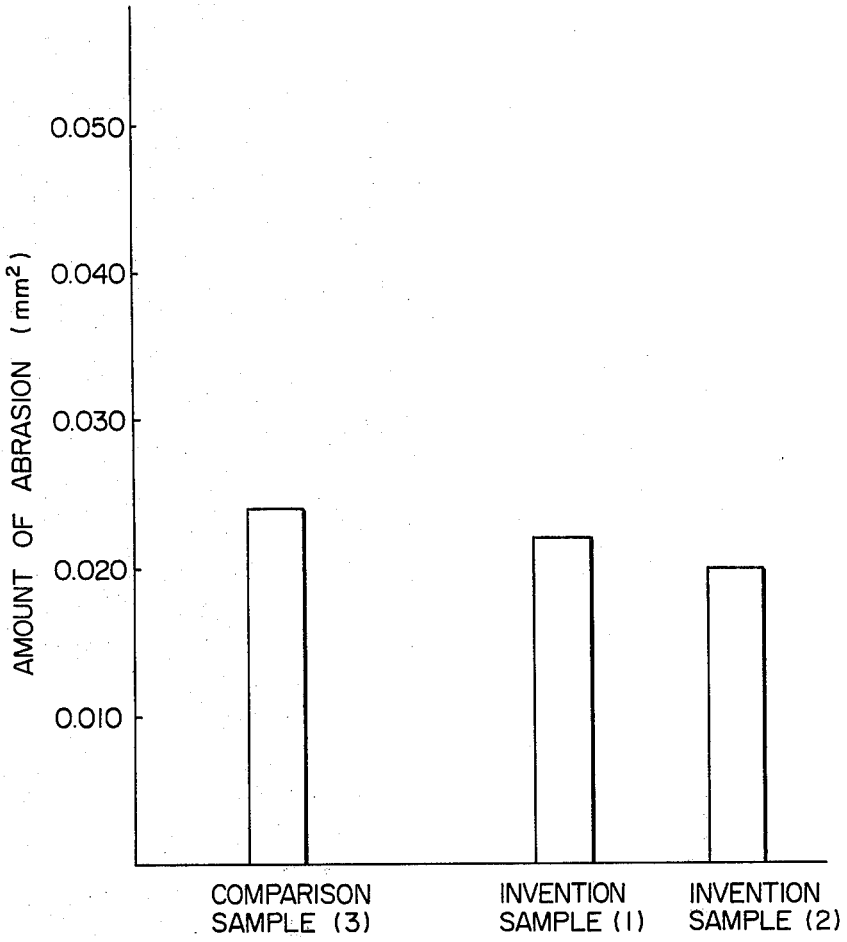

ABRASION RESISTANT FERRO-BASED SINTERED ALLOY

BACKGROUND OF THE INVENTION

1. Field of the Invention

The present invention relates to abrasion resistant ferro-based sintered alloy for use as abrasion resistant members of internal combustion engines, more particularly, those members which require high thermal resistance and high abrasion resistance simultaneously such as valve seats, valves, etc. and other slidable members for internal combustion engines.

2. Description of the Prior Art

Thermal and abrasion resistant sintered alloys for use as valve seats which can exhibit high abrasion resistance and thermal resistance and corrosion resistance even when leadless gasoline is used as a fuel are described in U.S. Pat. No. 3,827,863.

These materials comprise various elements introduced in large amounts in a form of alloy powder, powder mixture or single powder of the elements. The addition of the elements often causes a problem since these elements, in particular cobalt, are available only with difficulty.

Further, members to be used under the conditions of high temperatures and high loads tend to suffer various drawbacks, for example, lead will be fused and flow out when the alloy impregnated with lead is used, the hardness of those members subjected to steam treatment will be too high and the material will become brittle. In addition, productivity is decreased by the addition of production steps when such treatments are effected.

It is, therefore, strongly desired that alloy comprising as small as possible an amount of useful additive elements but exhibiting excellent thermal resistance, corrosion resistance and abrasion resistance simultaneously be developed to thereby save natural resources as well as improve productivity.

SUMMARY OF THE INVENTION

A primary object of the present invention is to eliminate the drawbacks involved in the prior arts and provide an alloy having excellent thermal resistance, corrosion resistance and abrasion resistance, simultaneously.

Another object of the present invention is to provide ferro-based alloy suitable for members such as valves, valve seats, etc. for internal combustion engines which are being employed under serious conditions, e.g., at high temperatures and under high loads, which comprises a small amount of alloy element to thereby reduce production cost thereof.

As a result of extensive research is attained the present invention which provides an abrasion resistant ferro-based sintered alloy comprising 1.1 to 1.6% by weight of carbon, 1.5 to 3.5% by weight of chromium, 1.6 to 2.9% by weight of molybdenum, 1.0 to 3.0% by weight of nickel, 3.0 to 5.0% by weight of cobalt, 0.5 to 1.5% by weight of tungsten, 1.8 to 18.0% by weight of copper and the balance iron wherein the alloy contains particles of specific alloy comprising C-Cr-W-Co and ferromolybdenum particles are uniformly dispersed in the base structure comprising a mixture of pearlite, bainite and martensite and wherein nickel and cobalt are distributed around the particles of specific alloy and of the ferromolybdenum alloy.

BRIEF DESCRIPTION OF THE DRAWINGS

Single FIGURE is a graph showing the results of comparative abrasion test on sintered alloys of the present invention and of the conventional ferro alloy.

DETAILED DESCRIPTION OF THE INVENTION

In the sintered alloy of the present invention, the amount of cobalt which is rather difficult to obtain and the price of which is very high is reduced and instead the amount of ferromolybdenum particles is increased to improve abrasion resistance. The ferromolybdenum particles generally remains undercomposed in the base structure comprising a mixture of pearlite, bainite and martensite. However, they are often dispersed and dissolved into the base structure to form a solid solution therewith when they are small particles or as far as the peripheral portion of the particles are concerned.

The base structure can be strengthened by the addition of nickel due to synergistic effect of nickel and molybdenum. Moreover, the addition of copper makes it possible to further strengthen the base structure. The purpose of the addition of copper is, one one hand, to offset the tendency of dimensional reduction due to the effect of nickel by the tendency of dimensional expansion given by copper, thereby facilitating control of dimension, and on the other hand to improve thermal conductivity which is an important function of members such as valve seats and the like for internal combustion engines.

The activity of the various individual components of the sintered alloy composition of the present invention and the reasons for limiting their amounts are explained below.

Carbon forms a solid solution with iron to form a tough pearlite structure in the base structure. If the amount of carbon is less than 1.1% by weight, the pearlite structure tends to be converted to ferrite which leads to reduction in abrasion resistance. On the other hand, when the amount of carbon is more than 1.6% by weight the content of the specific alloy of C-Cr-W-Co or graphite is increased and the content of cementite which render the alloy brittle strongly increases in the base structure resulting in that it degrades strength and machineability of the alloy. Therefore, the amount of carbon is limited to 1.1 to 1.6% by weight.

Chromium is dispersed in the base structure as alloy particles containing composite carbide of C-Cr-W-Co and contributes to afford the alloy abrasion resistance. The amount of chromium is limited to 1.5 to 3.5% by weight. This is because the use of less than 1.5% by weight of chromium gives insufficient amount of the composite carbide and thus degraded abrasion resistance, while the use of more than 3.5% by weight of chromium leads to the formation of excessive amount of carbide thereby rendering the alloy brittle and reducing the strength thereof.

Molybdenum, which can be added to the base structure in the form of ferromolybdenum powders, is dissolved partially in the base structure to form a solid solution therewith and the balance remains as is and forms hard ferromolybdenum particles dispersed in the base structure to improve abrasion resistance and strength at high temperatures. Thus, molybdenum is added in order to stabilize the structure of the alloy after sintering. When molybdenum is contained in an amount of less than 1.6% by weight the content of ferromolybdenum particles is small and abrasion resistance of the resulting alloy is degraded, while the base structure becomes brittle when the amount of molybdenum is more than 2.9% by weight. Therefore the amount of molybdenum is limited to 1.6 to 2.9% by weight.

Nickel is effective for toughening the base structure and at the same time for increasing strength of the base structure. In addition, this element contributes to conversion of a part of the base structure to martensite-bainite. If the amount of nickel is less than 1.0% by weight toughening of the base structure is insufficient, on the other hand, when more than 3.0% by weight of nickel is used the base structure is converted locally to martensite and the hardness of the alloy is increased excessively to destroy uniformity. Therefore, the suitable amount of nickel is selected to be 1.0 to 3.0% by weight.

Cobalt is added in order to improve corrosion resistance and bond the particles of the specific alloy of C-Cr-W-Co strongly to the base structure. When the amount of cobalt is less than 3.0% by weight desired strength, abrasion resistance and corrosion resistance cannot be obtained. On the other hand, the addition of cobalt in an amount of more than 5.0% by weight is useless in view of the amount of the particles of specific alloy of C-Cr-W-Co. Therefore, the amount of cobalt is limited to 3.0 to 5.0% by weight.

Tungsten which is dispersed in the base structure as particles of the specific alloy of C-Cr-W-Co is effective for obtaining satisfactory strength at high temperatures, thermal resistance and abrasion resistance. When tungsten is used in an amount of less than 0.5% by weight the amount of the particles of the specific alloy is insufficient and the effect of abrasion resistance is poor, while with more than 1.5% by weight of tungsten, no substantial increase is observed any further. Therefore, the amount of tungsten is limited to 0.5 to 1.5% by weight.

Copper is dispersed in the base structure and is effective not only for strengthening the base structure but also for offsetting the tendency of contraction of the alloy due to the effect of nickel by the effect of copper which has a tendency of expanding the alloy, resulting in that the dimension of the alloy articles can be controlled exactly. Copper is also effective for improving the thermal conductivity of members such as valve seats and the like for internal combustion engines. When the amount of copper is less than 1.5% by weight, the amount of copper which is dissolved in iron to form a solid solution therewith is insufficient resulting in reduction in the strength of the base structure, and in addition little effect of inhibiting contraction of the alloy due to the action of nickel is obtained. On the other hand, when the amount of copper is more than 18.0% by weight the amount of copper which is infiltrated into the alloy, i.e., which fills the space in the alloy, is increased and no further effect on the improvement of abrasion resistance can be obtained although thermal conductivity can be improved. Further, the content of copper has an upper limit of 18.0% by weight in view of the porosity of the skeleton. Therefore, the amount of copper is limtied to 1.8 to 18.0% by weight.

As stated above, the sintered alloy of the present invention should comprise 1.1 to 1.6% by weight of carbon, 1.5 to 3.5% by weight of chromium, 1.6 to 2.9% by weight of molybdenum, 1.0 to 3.0% by weight of nickel, 3.0 to 5.0% by weight of cobalt, 0.5 to 1.5% by weight of tungsten, 1.8 to 18.0% by weight of copper and the balance iron wherein the alloy contains particles of specific alloy comprising C-Cr-W-Co and ferromolybdenum particles are uniformly dispersed in the base structure comprising a mixture of pearlite, bainite and martensite and wherein nickel and cobalt are distributed around the particles of specific alloy and of ferromolybdenum alloy.

Referring now to the drawing examples of the ferro-based sintered alloy of the present invention are explained in greater detail in comparison with the conventional ferro-based sintered alloy.

Valve seat samples (1), (2) and (3) having the composition and physical properties as set forth below were prepared.

(1) Sintered Alloy of the Present Invention

Carbon 1.15%; Ni 1.50%; Cr 3.0%; Mo 2.5% W 0.8%; Co 3.8%; Cu 3.5%; balance Fe (by weight)
Hardness: Hardness on the Rockwell B scale of 87
Density: 6.62 g/cm$^3$ (2) Sintered Alloy of the Present Invention Carbon 1.12%; Ni 1.38%; Cr 2.80%; Mo 2.44%; W 0.75%; Co 3.56%; Cu 14.5%; balance Fe (by weight)
Hardness: Hardness on the Rockwell C scale of 35
Density: 7.92 g/cm$^3$ (3) Comparison Sintered Alloy (U.S. Pat. No. 3,827,863)

Carbon 1.2%; Ni 2.0%; Cr 11.0%; Mo 1.0%; W 3.2%; Co 7.0%; balance Fe (by weight)
Hardness: Hardness on the Rockwell B scale of 88
Density: 6.57 g/cm$^3$ These valve seat samples were subjected to abrasion test using a valve seat abrasion testing machine under the following conditions.

| | |
|---|---|
| Number of Rotation: | 3,000 r.p.m. |
| Test Repeating Number: | $8 \times 10^5$ |
| Valve Velocity at the Time of Valve Closing: | 0.5 m/sec. |
| Spring Pressure: | 35 kg |
| Number of Valve Rotation: | 8–10 r.p.m. |
| Heating: | Combustion of a mixture of propane and air |
| Test Temperature: | 300° C. |
| Composition of Counterpart Valve: | Stellite-covered |

Single FIGURE shows the results obtained from which it can be seen that notwithstanding the reduction in the amount of cobalt the ferro-based sintered alloy of the present invention exhibits abrasion resistance the same as or superior to the prior art ferro-based sintered alloy.

This improvement is believed to be ascribable to the synergistic effect obtained by very hard ferromolybdenum particles and particles of the specific alloy of C-Cr-W-Co. Further, it is believed that the prevention of ferromolybdenum particles from dropping out of the base structure by the dispersion therein, strengthening of the base structure by the addition of copper, and appropriate hardness given by the effect of martensite and bainite also add to the improvement of abrasion resistance of the ferro-based sintered alloy of the present invention.

While the invention has been described in detail and with reference to specific embodiments thereof, it will be apparent to one skilled in the art that various changes and modifications can be made therein without departing from the spirit and scope thereof.

We claim:

1. An abrasion resistant ferro-based sintered alloy comprising 1.1 to 1.6% by weight of carbon, 1.5 to 3.5% by weight of chromium, 1.6 to 2.9% by weight of molybdenum, 1.0 to 3.0% by weight of nickel, 3.0 to 5.0% by weight of cobalt, 0.5 to 1.5% by weight of tungsten, 1.8 to 18.0% by weight of copper and the balance iron wherein said alloy contains particles of specific alloy comprising C-Cr-W-Co and ferromolybdenum particles are uniformly dispersed in the base structure comprising a mixture of pearlite, bainite and martensite and wherein nickel and cobalt are distributed around the particles of specific alloy and of ferromolybdenum alloy.

* * * * *